United States Patent [19]

Dunn

[11] Patent Number: 4,895,285

[45] Date of Patent: Jan. 23, 1990

[54] GUN VEST

[76] Inventor: Joseph L. Dunn, 1309 Floyd St., Conway, S.C. 29526

[21] Appl. No.: 197,423

[22] Filed: May 23, 1988

[51] Int. Cl.[4] ..... F41C 23/02

[52] U.S. Cl. ..... 224/149; 224/200; 224/913; 2/94

[58] Field of Search ..... 224/149, 150, 913, 219, 224/221, 200; 2/94, 79

[56] References Cited

U.S. PATENT DOCUMENTS

| | | | |
|---|---|---|---|
| 919,301 | 4/1909 | Anderson . | |
| 1,426,540 | 8/1922 | Bernstein | 2/79 |
| 1,879,341 | 9/1932 | Lapham . | |
| 2,520,285 | 8/1950 | Olson . | |
| 2,635,246 | 4/1953 | Olson . | |
| 2,762,054 | 9/1956 | Smith | 2/94 |
| 2,948,449 | 8/1960 | Aronson . | |
| 2,985,347 | 5/1961 | DeNeve . | |
| 3,081,923 | 3/1963 | Bagby . | |
| 3,130,416 | 4/1964 | Mitchell et al. | 2/94 |
| 3,348,746 | 10/1967 | Stumpf . | |
| 3,430,828 | 3/1969 | Gregson . | |
| 3,606,109 | 9/1971 | Brokus . | |
| 3,700,147 | 10/1972 | Vaughn . | |
| 3,869,074 | 3/1975 | Roach . | |

*Primary Examiner*—Linda J. Sholl

*Attorney, Agent, or Firm*—Roylance, Abrams, Berdo & Goodman

[57] ABSTRACT

A gun vest including a pocket assembly which receives the butt end of a gun stock to partially support the gun while it is being carried and fired. The gun vest includes a torso portion, a shoulder portion, a leg portion and the pocket assembly. The torso portion is designed to be worn about the midsection of the person. The shoulder portion extends upward from the torso portion and is designed to be worn about one shoulder of the person. The leg portion extends downward from the torso portion and is designed to be worn about one leg of the person. The torso portion includes waist straps and the shoulde portion includes shoulder straps for releasably fastening the gun vest about the person The pocket assembly includes a flexible extension member and a pocket which receives the gun butt. The extension member has a first end which is attached to the torso portion of the gun vest. The pocket member is attached to the second end. The entire gun vest can be made of the same flexible fabric and be designed such that it is comprised of continuous fabric which clothes the midsection of the person when the person is wearing the gun vest.

37 Claims, 2 Drawing Sheets

GUN VEST

FIELD OF THE INVENTION

This invention relates to hunting slings and vests which includes pockets or straps for carrying and supporting a gun during firing of the gun. More specifically, the invention relates to such slings and vests which are designed to be worn about the midsection of the gunman's body and include a pocket member for receiving the butt end of a gun stock.

BACKGROUND OF THE INVENTION

Gun sport hunting inevitably involves the carrying of a gun for hours at a time. In addition, sport hunting is frequently conducted in treacherous terrain, i.e., hilly or mountainous terrain having thick underbrush vegetation. For these reasons, sport hunting can be a very tiresome activity, especially for persons having a physical handicap such as an artificial shoulder, limb, etc. The more tired a hunter becomes, the greater is the risk of a hunting accident occurring.

Also, most sporting guns have a large recoil force when fired. This recoil force can be dangerous to any person, especially a person with a physical handicap as discussed above. For these reasons, gun slings and vests have been developed which partially support a gun while the gun is being carried and/or fired.

Numerous gun slings and vests are known in the prior art for supporting the lower portion of a gun stock while the gun is being carried or fired. Examples of these prior art gun slings and vests are disclosed in U.S. Pat. No. 919,301 issued on Apr. 27, 1909 to Anderson; U.S. Pat. No. 1,879,341 issued on Sept. 27, 1932 to Lapham; U.S. Pat. No. 2,520,285 issued on Aug. 29, 1950 to Olson; U.S. Pat. No. 2,635,246 issued on Apr. 21, 1953 to Olson; U.S. Pat. No. 2,948,449 issued on Aug. 9, 1960 to Aronson et al.; U.S. Pat. No. 2,985,347 issued on May 23, 1961 to DeNeve; U.S. Pat. No. 3,081,923 issued on Mar. 19, 1963 to Bagby; U.S. Pat. No. 3,348,746 issued on Oct. 24, 1967 to Stumpf; U.S. Pat. No. 3,430,828 issued on Mar. 4, 1969 to Gregson; U.S. Pat. No. 3,606,109 issued on Sept. 20, 1971 to Brokus; U.S. Pat. No. 3,700,147 issued on Oct. 24, 1972 to Vaughn; and U.S. Pat. No. 3,869,074 issued on Mar. 4, 1975 to Roach.

These gun slings and vests have numerous disadvantages. For example, many of the prior slings and vests cannot be used by a person with certain physical handicaps involving a person's upper body since the gun must still be fired from the person's shoulder. In addition, many of these prior art slings utilize straps and/or belts which at the least are uncomfortable since the straps and belts tend to dig into the user's body, and may cause sores, especially, if the gun is fired while positioned in the sling. Moreover, many of these prior gun slings and vests are very expensive to manufacture because they are comprised of numerous parts. Further, many of these slings and vests do not adequately support the gun during the carrying and firing of the gun.

In view of the above, it is apparent that there exists a need for a gun vest which can be employed by almost everyone, including persons with certain physical handicaps, which reduces the risk of injury to persons wearing the vest and which makes hunting more comfortable and thus safer for all hunters.

This invention addresses this need in the art, along with other needs which will become apparent to those skilled in the art once given this disclosure.

SUMMARY OF THE INVENTION

This invention provides a gun vest including a torso portion, a shoulder portion, a leg portion and a member for receiving and retaining a gun stock. The torso portion is designed to be worn about the midsection of the person. The shoulder portion extends upward from the torso portion and is designed to be worn about one shoulder of the person. The leg portion extends downward from the torso portion and is designed to be worn about one leg of the person. The member for receiving and retaining a gun stock is attached to one of the torso, shoulder and leg portions.

Other embodiments of this invention may include various coupling members for releasably coupling the gun vest about the person. These coupling members may be affixed to at least one of the torso, shoulder and leg portions. More particularly, in these embodiments, the torso portions may include first and second waist straps, each of the waist straps having a free end. The coupling members may include a first pair of mating coupling devices attached to the free ends of the waist straps. When this first pair of mating coupling devices are coupled, the waist straps retain the gun vest around the midsection of the person. Also, the shoulder portion may include first and second shoulder straps, each of the shoulder straps having a free end. A second pair of mating coupling devices may be attached to the free ends of the shoulder straps such that when the second pair of coupling devices are coupled, the shoulder straps retain the gun vest about one shoulder of the person.

In further embodiments of this invention, the leg portion may include leg straps for adjusting the tightness of the leg portion about the person's leg.

In yet other embodiments, the member which receives and retains the gun stock may include a flexible extension member having first and second ends and a pocket member. The first end of the extension member may be attached to at least one of the torso, shoulder and leg portions. The pocket member can be attached to the second end of the extension member. The pocket member may be designed to receive and retain the butt end of the gun stock therein.

In some embodiments, the torso, shoulder and leg portions and the member for receiving and retaining a gun stock are comprised of the same fabric. The gun vest may be comprised of a continuous fabric which clothes the midsection of the person and one side of the person from the shoulder to the upper thigh when the person is wearing the gun vest.

In yet other embodiments, the member which receives and retains the butt end of a gun stock may be affixed to the torso portion of the gun vest such that the receiving and retaining member is adjacent the waist of the person when the person is wearing the gun vest.

The gun vests according to this invention have many advantages over prior gun vests and slings designed for the same purpose.

First, the gun vests according to this invention can be worn by persons having certain handicaps which may have previously prevented such handicapped persons from sport hunting. Such handicaps may include persons with implanted artificial shoulders, persons with artificially pinned shoulders, persons who have undergone open heart surgery, persons having an implanted heart pacemaker, etc. Such persons may be able to enjoy sport hunting without risk if they wear a gun vest according to this invention.

Another advantage of the gun vests according to this invention is that the recoil force resulting from the firing of the gun support by one of the gun vests is distributed across a user's hips and midsection. This reduces the risk of certain injuries, including injuries to shoulders and the upper body.

A further advantage of the gun vests according to this invention is that a gun can be fired while retained by one of the vests from an unlimited number of angles and positions. The vests do not limit the field of range in which the gun can be fired.

Yet another advantage of the gun vests according to this invention is that the vests are very comfortable since they are made of continuous fabric. There are no belts or straps which may rub a person's body until a sore is developed.

Still another advantage of the gun vests according to this invention is that the gun vests are strong, durable and dependable, yet relatively inexpensive to manufacture.

Yet another advantage is that a person wearing a gun vest according to this invention can carry a firearm in one hand.

A further advantage of this invention is that the wearing of a gun vest according to this invention renders hunting more safe. The use of a gun vest according to this invention reduces the fatigue and wear on the gunman wearing the vest. The less fatigued and more comfortable the gunman is, the lesser is the risk of a hunting accident occurring.

Other advantages and salient features of the invention will become apparent from this disclosure. Certain embodiments of this invention will now be described with respect to the drawings which form a part of this disclosure:

DETAILED DESCRIPTION OF THE INVENTION

Figure 1:
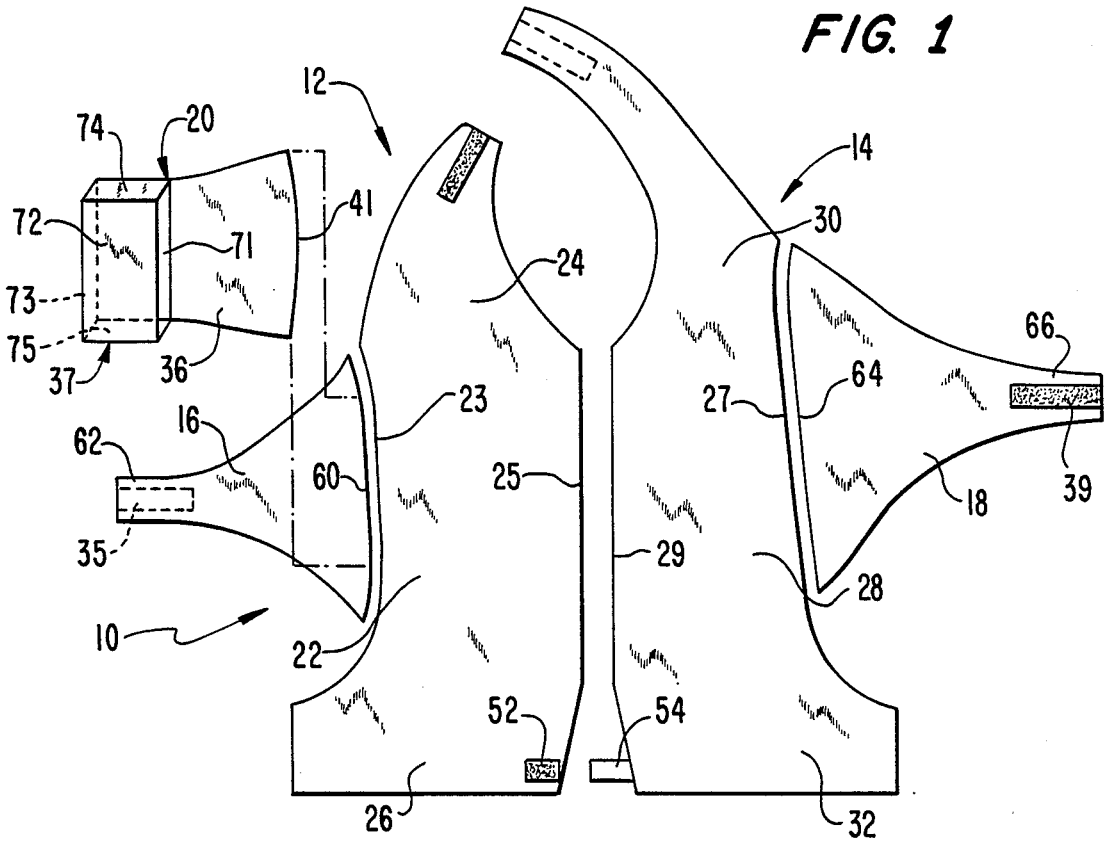
FIG. 1 is an exploded, front elevational view of one embodiment of this invention.

Referring to the Figures, and in particular FIGS. 1 and 4–6, a gun vest according to this invention, gun vest 10, is illustrated which includes front panel 12, back panel 14, first waist strap 16, second waist strap 18 and receiving pocket assembly 20. All of these elements of gun vest 10 are preferably formed of a flexible fabric, such as a canvas-like material. In fact, all of these elements can be made of the same fabric. The fabric preferably is camouflage colored and patterned, although gun vest 10 could be any color or bear any pattern.

Figure 2:
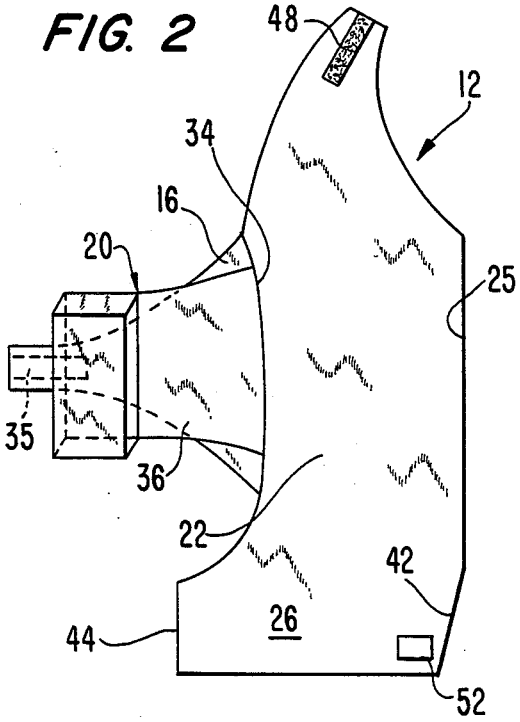
FIG. 2 is a front elevational view of the front half of the embodiment of this invention illustrated in FIG. 1.

Front panel 12 includes front torso portion 22, front shoulder portion 24 and front leg portion 26, which are preferably integrally formed from a single piece of fabric (see FIG. 2). Front shoulder portion 24 extends upwardly and front leg portion 26 extends downwardly from front torso portion 22. Front torso portion 22 includes front edge 23 and rear edge 25. Front leg portion 26 includes rear edge 42 and front edge 44.

Figure 3:
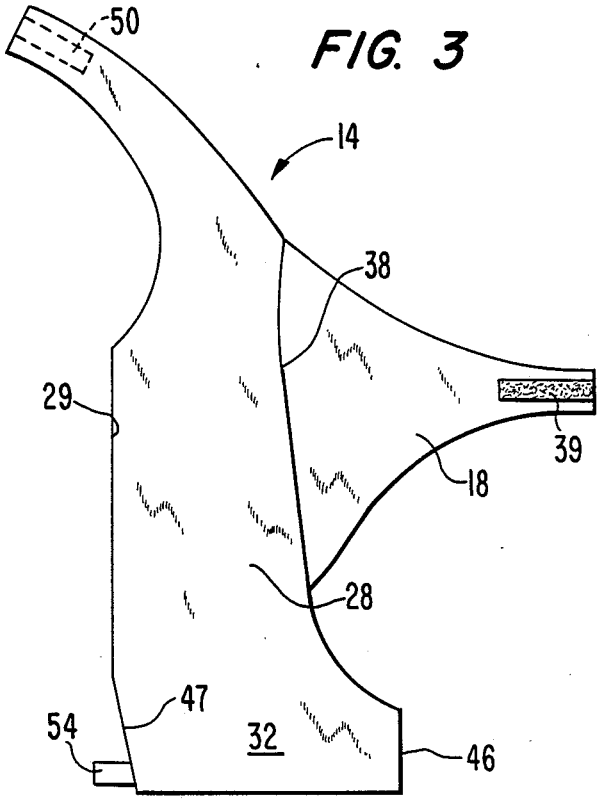
FIG. 3 is a front elevational view of the back half of the embodiment of this invention illustrated in FIGS. 1 and 2.

Back panel 14 includes back torso portion 28, back shoulder portion 30 and back leg portion 32 which are also preferably integrally formed from a single piece of fabric (see FIG. 3). Back shoulder portion 30 extends upwardly and back leg portion 32 extends downwardly from back torso portion 28. Back torso portion 28 includes front edge 27 and back edge 29. Back leg portion 32 includes front edge 46 and rear edge 47.

First waist strap 16 is generally triangularly-shaped and includes edge 60 and strap portion 62. Edge 60 is sewn to front edge 23 of front torso portion 22, forming seam 34. VELCRO ® portion 35 is affixed to the outer surface of strap portion 62.

Second waist strap 18 is also generally triangularly-shaped and includes edge 64 and strap portion 66. Edge 64 is sewn to front edge 27 of back torso portion 28, forming seam 38. VELCRO ® portion 39 is affixed to the underside of strap portion 66.

Pocket assembly 20 includes extension 36 and pocket 37. Extension 36 is a single flat sheet of fabric including edge 41. Pocket 37 includes side walls 71 and 72, back wall 73, top wall 74 and bottom wall 75. Walls 71–75 are connected at their edges to form an open-ended box, a shown in the figures. Side wall 71 is sewn to the end of extension 36 opposite edge 41, such that pocket 37 is located in front of extension 36. Side wall 71 and extension 36 may partially overlap or may be an integral piece of fabric, as desired.

Figure 7:
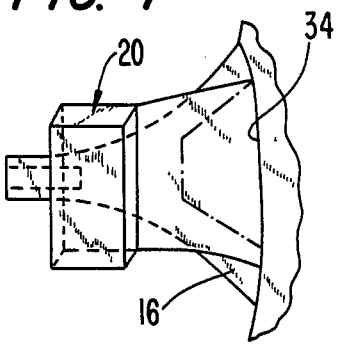
FIG. 7 is a partial, front elevational view of the pocket and adjacent vest portion of the embodiment of this invention illustrated in FIGS. 1–6.

In the embodiment illustrated in FIG. 7, edge 41 is sewn to front edge 23 of front torso portion 22 and edge 60 of first waist strap 16 at seam 34.

Mating VELCRO ® portions 48 and 50 are affixed to the uppermost ends of shoulder portions 24 and 30, respectively, with one of the portions 48 and 50 being affixed to the outside and the other of the portions being affixed to the inside of the portions 48 and 50.

Mating VELCRO ® portions 52 and 54 are affixed near rear edges 42 and 44 of leg portions 26 and 32, respectively. Portion 54 extends outwardly from edge 47 (see FIGS. 1 and 3).

Gun vest 10 is assembled by sewing edge 25 of front torso portion 22 to edge 29 of back torso portion 28, forming seam 43, and by sewing front edge 44 of front leg portion 26 to front edge 46 of back leg portion 32, forming seam 45. Rear edges 42 and 47 of front leg portion 26 and rear leg portion 32, respectively, are not sewn together.

Gun vest 10 is employed as follows. First, the wearer places his or her leg (in the embodiment illustrated in the Figures) into the opening formed by leg portions 26 and 32.

Next, first waist strap 16 and second waist strap 18 are positioned comfortably but firmly around the waist of the wearer and mating VELCRO ® portions 35 and 39 are brought into engagement, and front shoulder portion 24 and back shoulder portion 30 are positioned comfortably but firmly about the left shoulder of the wearer and mating VELCRO ® portions 48 and 50 are brought into engagement. Waist straps 16 and 18 retain gun vest 10 about the midsection and shoulder portions 24 and 30 retain gun vest 10 about the left shoulder of the wearer of gun vest 10.

Finally, mating VELCRO ® portions 52 and 54 can be brought into engagement to adjust the tightness of leg portions 26 and 32 about the wearer's left leg.

Figure 4:
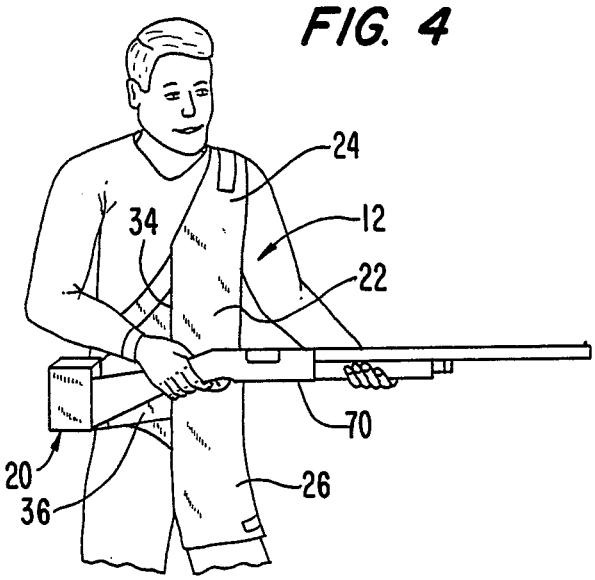
FIG. 4 is a front perspective view of the embodiment of this invention illustrated in FIGS. 1–3 being worn by a gunman holding a gun in substantially horizontal position with the butt end of the gun in the pocket of the gun vest.
Figure 5:
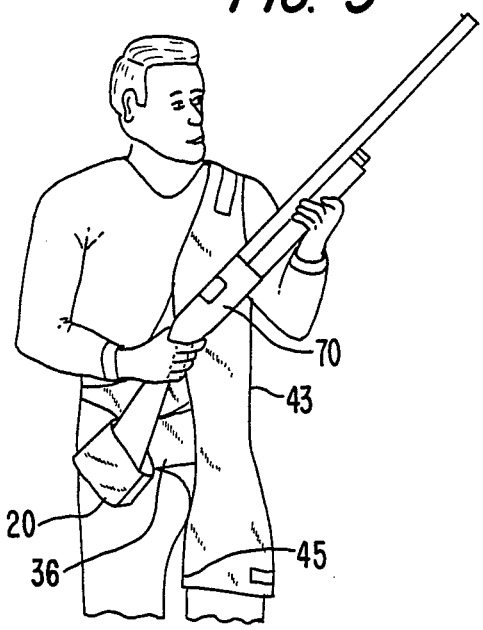
FIG. 5 is a front perspective view of the embodiment of this invention illustrated in FIGS. 1–4 being worn by a gunman holding a gun at approximately a 45° angle with his body, the gun butt being in the pocket of the gun vest.
Figure 6:
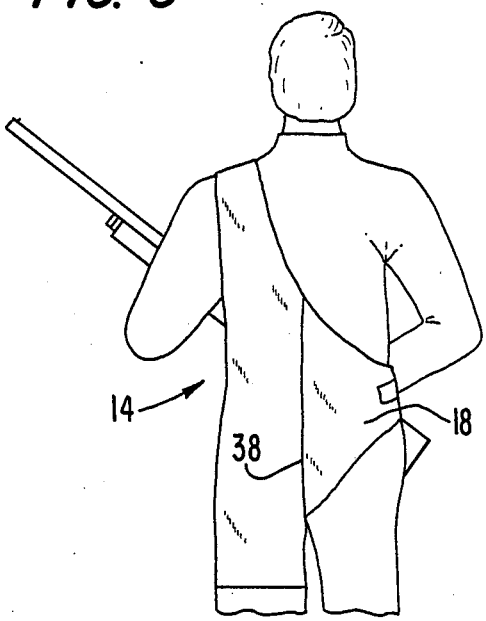
FIG. 6 is a rear elevational view of the embodiment of this invention illustrated in FIGS. 1–5 being worn by a gunman.

As seen in FIGS. 4–6, the vest 10 is fitted about the wearer's body such that front panel 12 and rear panel 14 overlie substantially the left half of the wearer's body, from the left shoulder to the upper left thigh. Waist straps 16 and 18 extend around the right midsection of the wearer.

The butt of gun 70 can be placed in pocket 37 to provide support while the wearer is carrying and firing gun 70. Since extension 36 and pocket 37 are flexible, gun 70 can be positioned at almost any angle relative the longitudinal axis of gun vest 10. For example, FIGS. 5 and 6 illustrate gun 70 being carried at an approximate 45° angle and FIG. 4 illustrates the gun being carried horizontally, for firing.

Figure 8:
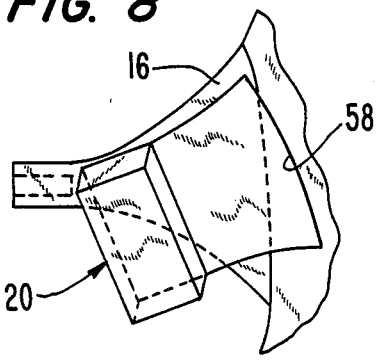
FIG. 8 is a partial, front elevational view of a second pocket configuration which can be employed in the embodiment of this invention illustrated by FIGS. 1–6.

As illustrated in FIGS. 7 and 8, extension 36 of pocket assembly 20 can be attached to front panel 12 and/or front waist strap 16 at various angles so as to distribute the force from the recoil of the gun on different body parts as desired. As discussed above, in FIG. 7, extension 36 is sewn along sewn 34 which extends substantially parallel to the longitudinal axis of vest 10. When gun 70 is fired in a vest having this arrangement, the recoil force will be concentrated on the waist of the gunman. In the embodiment of this invention illustrated in FIG. 8, extension 36 is sewn to front panel 12 and front waist strap 16 along seam 58, which extends at an angle to the longitudinal axis of vest 10. If a gun is fired in a vest having this arrangement, the recoil force will be concentrated on the waist and upper body of the gunman.

Various modifications, improvements and other embodiments will become apparent to those skilled in the art once given this disclosure. Such modifications, improvements and other embodiments are considered to be within the scope of this invention as defined by the following claims.

What is claimed is:

1. A gun vest comprising:

a torso portion designed to be worn about the midsection of a person;

a single shoulder portion extending upward from said torso portion and designed to be worn about one shoulder of the person;

a single leg portion extending downward from said torso portion and designed to be worn about one leg of the person; and first means for receiving and retaining a gun stock therein, said first means being attached to at least one of said torso, shoulder and leg portions.

2. A gun vest according to claim 1, further comprising second means for releasably coupling said gun vest about the person, said second means being affixed to at least one of said torso, shoulder and leg portions.

3. A gun vest according to claim 2, wherein said torso portion includes first and second waist straps, each of the waist straps having a free end;

said second means includes a first pair of mating coupling members affixed to said free ends of said waists straps wherein when said first pair of mating coupling members are coupled together said waist straps retain said gun vest around the midsection of the person.

4. A gun vest according to claim 3, wherein said shoulder portion includes first and second shoulder straps, each of said shoulder straps having a free end;

said second means includes a second pair of mating coupling members affixed to said free ends of said shoulder straps;

wherein when said second pair of mating coupling members are coupled, said shoulder straps retain said gun vest about one shoulder of the person.

5. A gun vest according to claim 4, wherein said leg portion includes third means for adjusting the tightness of said leg portion around the person's leg.

6. A gun vest according to claim 1, wherein said first means includes a flexible extension member having first and second ends and a pocket member;

said first end of said extension member being attached to at least one of said torso, shoulder and leg portions;

said pocket member being affixed to said second end of said extension member;

said pocket member being designed to receive and retain the butt end of a gun stock therein.

7. A gun vest according to claim 6, wherein said pocket member has first and second side walls, a top wall, a bottom wall and a back wall connected on edges to form an open-ended box.

8. A gun vest according to claim 7, wherein said first end of said extension member is affixed to said torso portion.

9. A gun vest according to claim 8, wherein said first end of said extension member is affixed to said torso portion along a line that extends substantially parallel to the longitudinal axis of the vest when worn by the person.

10. A gun vest according to claim 8, wherein said extension member is affixed to said torso portion along a line that extends at an angle to the longitudinal axis of the vest when worn by the person.

11. A gun vest according to claim 1 wherein said torso, shoulder and leg portions and said first means are all comprised of the same fabric.

12. A gun vest according to claim 1 wherein said gun vest is comprised of continuous fabric which clothes the midsection of the person when the person is wearing said gun vest.

13. A gun vest according to claim 1 wherein said first mean is affixed to said torso portion.

14. A gun vest according to claim 1 wherein said first means is affixed to said torso portion such that said first means is adjacent said waist of the person when the person is wearing said gun vest.

15. A gun vest comprising:

a torso portion designed to be worn about the midsection of a person;

a shoulder portion extending upward from said torso portion and designed to be worn about one shoulder of the person;

a portion extending downward from said torso portion and designed to be worn about one leg of the person; and first means for receiving and retaining a gun stock therein, said first means being attached to said torso portion;

wherein said first means includes a flexible extension member having first and second ends and a pocket member;

said first end of said extension member being attached to said torso portion;

said pocket member being affixed to said second end of said extension member;

said pocket member being designed to receive and retain the butt end of a gun stock therein;

wherein said first end of said extension member is affixed to said torso portion along a line that extends substantially parallel to the longitudinal axis of the vest when worn by the person.

16. A gun vest according to claim 15, further comprising second means for releasably coupling said gun vest about the person, said second means being affixed to at least one of said torso, shoulder and leg portions.

17. A gun vest according to claim 15 wherein said torso, said shoulder and leg portions and said first means are all comprised of the same fabric.

18. A gun vest according to claim 15 wherein said gun vest is comprised of continuous fabric which clothes the midsection of the person when the person is wearing said gun vest.

19. A gun vest comprising:

a torso portion designed to be worn about the midsection of a person;

a single shoulder portion extending upward from said torso portion and designed to be worn about one shoulder of the person;

a leg portion extending downward from said torso portion and designed to be worn about one leg of the person; and first means for receiving and retaining a gun stock therein, said first means being attached to at least one of said torso, shoulder and leg portions.

20. A gun vest according to claim 19, further comprising second means for releasably coupling said gun vest about the person, said second means being affixed to at least one of said torso, shoulder and leg portions.

21. A gun vest according to claim 20, wherein said torso portion includes first and second waist straps, each of the waist straps having a free end;

said second means includes a first pair of mating coupling members affixed to said free ends of said waists straps wherein when said first pair of mating coupling members are coupled together said waist straps retain said gun vest around the midsection of the person.

22. A gun vest according to claim 21, wherein said leg portion includes third means for adjusting the tightness of said leg portion around the person's leg.

23. A gun vest according to claim 19, wherein said first means includes a flexible extension member having first and second ends and a pocket member;

said first end of said extension member being attached to at least one of said torso, shoulder and leg portions;

said pocket member being affixed to said second end of said extension member;

said pocket member being designed to receive and retain the butt end of a gun stock therein.

24. A gun vest according to claim 23, wherein said first end of said extension member is affixed to said torso portion.

25. A gun vest according to claim 24, wherein said first end of said extension member is affixed to said torso portion along a line that extends substantially parallel to the longitudinal axis of the vest when worn by the person.

26. A gun vest according to claim 19, wherein said torso, shoulder and leg portions and said first means are all comprised of the same fabric.

27. A gun vest according to claim 19 wherein said gun vest is comprised of continuous fabric which clothes the midsection of the person when the person is wearing said gun vest.

28. A gun vest comprising:

a torso portion designed to be worn about the midsection of a person;

a shoulder portion extending upward from said torso portion and designed to be worn about one shoulder of the person;

a single leg portion extending downward from said torso portion and designed to be worn about one leg of the person; and first means for receiving and retaining a gun stock therein, said first means being attached to at least one of said torso, shoulder and leg portions.

29. A gun vest according to claim 28, further comprising second means for releasably coupling said gun vest about the person, said second means being affixed to at least one of said torso, shoulder and leg portions.

30. A gun vest according to claim 29, wherein said torso portion includes first and second waist straps, each of the waist straps having a free end;

said second means includes a first pair of mating coupling members affixed to said free ends of said waists straps wherein when said first pair of mating coupling members are coupled together said waist straps retain said gun vest around the midsection of the person.

31. A gun vest according to claim 30, wherein said leg portion includes third means for adjusting the tightness of said leg portion around the person's leg.

32. A gun vest according to claim 31, wherein said leg portion does not extend below the knee of the person when the person is wearing said vest.

33. A gun vest according to claim 28, wherein said first means includes a flexible extension member having first and second ends and a pocket member;

said first end of said extension member being attached to at least one of said torso, shoulder and leg portions;

said pocket member being affixed to said second end of said extension member;

said pocket member being designed to receive and retain the butt end of a gun stock therein.

34. A gun vest according to claim 33, wherein said first end of said extension member is affixed to said torso portion.

35. A gun vest according to claim 34, wherein said first end of said extension member is affixed to said torso portion along a line that extends substantially parallel to the longitudinal axis of the vest when worn by the person.

36. A gun vest according to claim 28, wherein said torso, shoulder and leg portions and said first means are all comprised of the same fabric.

37. A gun vest according to claim 28 wherein said gun vest is comprised of continuous fabric which clothes the midsection of the person when the person is wearing said gun vest.

* * * * *